United States Patent [19]

Durkin et al.

[11] Patent Number: 4,989,325

[45] Date of Patent: Feb. 5, 1991

[54] HAND TOOL FOR REMOVING COLLAR FROM LOCK BOLT

[75] Inventors: John E. Durkin, Everett; K. Peter Kenney, Bothell; Dean F. Hobart, Renton, all of Wash.

[73] Assignee: The Boeing Company, Seattle, Wash.

[21] Appl. No.: 447,008

[22] Filed: Dec. 6, 1989

[51] Int. Cl.[5] ..... B26B 29/00; B26B 17/00; B26B 13/00

[52] U.S. Cl. ..... 30/287; 30/185; 30/243

[58] Field of Search ..... 30/287, 288, 286, 353, 30/273, 278, 279 R, 243, 185, 242, 246, 245

[56] References Cited

U.S. PATENT DOCUMENTS

| | | | |
|---|---|---|---|
| 308,267 | 11/1884 | Levalley | 30/185 |
| 328,249 | 10/1885 | Parker | 30/185 |
| 362,137 | 5/1887 | Woolgar | 30/185 |
| 551,686 | 12/1895 | Murphy | 30/185 |
| 554,504 | 2/1896 | Clinch | 30/243 |
| 631,123 | 8/1899 | Norris | 30/243 |
| 814,100 | 3/1906 | Webster | 30/243 |
| 1,545,188 | 7/1925 | Hultgren | 30/243 |
| 1,778,791 | 10/1930 | Brant et al. | 30/185 |

OTHER PUBLICATIONS

Form No. CA 132 2/85, "Installation Sequence", of Huck Manufacturing Company, Carson, Calif.

*Primary Examiner*—Douglas D. Watts
*Assistant Examiner*—Paul M. Heyrana, Sr.
*Attorney, Agent, or Firm*—Joan H. Pauly

[57] ABSTRACT

A tool body (32) has a forward cradle (34) that surroundingly receives a fastener collar (14). A slider (68) is slid in a cavity (40) in the body (32) by a lever (56) pivotably attached to the body (32). Cutting edges (70) on either side of a slot (74) in the slider (68) cut the collar (14). Spreading surfaces (72) adjacent to the edges (70) spread the collar material away from the fastener shaft. The lever (56) has cam surfaces (60, 62) that engage a hook (78) on the rear end of the slider (68) to move the slider (68) forward and back perpendicular to the fastener shaft axis (X).

21 Claims, 4 Drawing Sheets

HAND TOOL FOR REMOVING COLLAR FROM LOCK BOLT

Description

TECHNICAL FIELD

This invention relates to hand tools for cutting collars off lock bolt fasteners and the like and, more particularly, to such a tool that has a cradle that circumferentially surrounds the collar and a slider that is moved by a lever in a radial direction relative to the collar to cut the collar.

BACKGROUND OF THE INVENTION

In the aircraft and other industries, lock bolt type fasteners are often used in order to provide a tight and secure connection between two elements. Such fasteners commonly have a collar that is swaged onto the shaft of the fastener for permanent attachment thereto. The collar cannot be removed without destroying the collar. Thus, the tightness and security of the connection is greater than can be obtained by the use of other types of fasteners, such as threaded fasteners with nuts, that can be removed without destroying any part of the fastener.

A commonly used type of lock bolt is the type sold by Huck Manufacturing Company of Carson, Calif. under the trademark HUCK. An example of this type of fastener 6 is shown in FIGS. 1 and 2. The fastener 6 has a head 8 formed at the outer end of a shaft portion, generally referred to as the "pin". The shaft portion extends along an axis X. At an axial midportion of the shaft or pin, a breakneck groove 13 is formed separating the permanent portion of the shaft from an inner breakoff portion 12. Parallel circumferential grooves 10 are formed on the shaft axially outwardly of the breakneck groove 13. The fastener 6 is held in position securing together two structures 2, 4 by a collar 14 made from aluminum or titanium. The portion of the collar 14 that abuts the inner surface of the structure 4 has a radial flange 16 formed thereon.

In order to install the fastener 6, the collar 14 is placed over the inner end of the pin 12 and is moved into position with the flange 16 abutting the inner surface of the structure 4. Then, a power operated tool pulls axially on the inner portion 12 of the pin to draw the structures 2, 4 together. As the pull on the pin 12 increases, an anvil portion of the tool swages the collar 14 into the circumferential locking grooves 10 to form a permanent lock. The tool continues to pull until the pin breaks at the breakneck groove 13 and the inner pin portion 12 is ejected. Finally, the tool anvil disengages from the swaged collar 14. The drawing together of the structures 2, 4 and the locking engagement of the collar material in the locking grooves 10 provide a tight and secure connection between the structures 2, 4. This connection is illustrated in FIG. 2.

The type of tight, secure connection provided by lock bolt fasteners, such as the fastener 6 shown in FIGS. 1 and 2, is required in a number of situations in the manufacture of aircraft. However, the illustrated fastening connection has the disadvantage of not being readily detachable when repair of one of the structures 2, 4 or adjacent components is required. The fastener 6 cannot be removed without removing the collar 14, and the collar 14 cannot be removed without destroying it. In some circumstances, the destruction of the collar 14 without damaging the structures 2, 4 is extremely difficult, if not impossible, using known methods. While, in most cases, damage to metallic structures is not a problem, structures made from other types of material are vulnerable to damage. One such type of material is fiber reinforced, resin matrix composite materials, such as graphite fiber reinforced epoxy resin plastics, which are being used increasingly in the manufacture of aircraft. Such materials are likely to be damaged if the collar 14 is subjected to an impact force sufficient to smash the collar 14 off the shaft of the fastener 6.

The applicants are aware of only four known methods of removing a collar 14 that comply with the high standards applicable to the manufacture and repair of aircraft. Two of these methods require access to the collar 14 from a vertical direction, i.e. from a direction parallel to the axis X of the fastener 6. One method is to use a bolt cutter which resembles hedge shears with short jaws and which cuts vertically along both sides of the collar 14 simultaneously. The other method uses an attachment to the type of tool used to install a lock bolt fastener, as described above, and has vertical blades which act in a manner similar to the bolt cutter blades. Both of these vertical methods may be used in situations in which the fastener 6 joins composite material structures. However, a major problem in many areas of an aircraft is the lack of space available, and the consequent lack of sufficient access to the collar 14 to approach it vertically. In such situations, a collar removing tool must engage the collar 14 in a horizontal direction, i.e. in a plane perpendicular to the axis X.

FIGS. 3 and 4 illustrate the only type of prior horizontal collar remover known to the applicants. The illustrated tool 20 has a forward end with end surfaces 24 on opposite sides of a slot 26. The slot 26 is sized to be very slightly wider than the diameter of the shaft of the fastener 6. In use, the front end surfaces 24 of the tool 20 are placed against the collar 14, as shown in FIG. 4. Then, the rear end 22 of the tool 20 is struck with a hammer to smash or shear the collar 14 off. The direction of the force of the hammer blow is essentially along the axis of the tool 20 and is indicated by the arrow in FIG. 4. The tool 20 shown in FIGS. 3 and 4 works well to remove an aluminum or titanium collar 14 and is acceptable for use when the structures engaged by the fastener 6 are metallic. However, the hammer impact force required is of a magnitude unacceptable for composite material structures 2, 4.

Currently, collars are being removed from lock bolt fasteners in situations involving composite materials by drilling the collars off. This approach has proved less than satisfactory. One major drawback is that the drilling procedure is relatively tedious and time consuming. Another major drawback is that the drill tends to slip off the collar 14 and damage the composite material. This leads to a need for more extensive repairs than were originally required and further increases the amount of time required for the repairs. In addition, drilling the collar off from a horizontal direction is impractical, and therefore the drilling must generally be done in a vertical direction.

Because of the significant limitations of the known methods of removing collars from lock bolt type fasteners, there is currently a great need in the aircraft industry for a tool that will reliably and consistently remove collars from lock bolts in limited access areas without damaging composite material structures joined by the lock bolts.

SUMMARY OF THE INVENTION

The present invention solves the problems discussed above by providing a tool that approaches a collar on a lock bolt horizontally and that is operable without the use of an impact force with a magnitude sufficient to damage composite material structures joined by the lock bolt. Since the tool engages the collar horizontally, it may be used in situations in which vertical access to the collar is restricted. Since the operation of the tool does not require the type of high impact force necessary to operate the prior tool shown in FIGS. 3 and 4, the tool of the invention may be used in situations in which one or more of the components joined by the lock bolt are made from composite materials or other types of materials that are vulnerable to damage when subjected to impact forces. The applicants anticipate that the tool of the invention will readily remove virtually all aluminum collars and at least most titanium collars without subjecting the joined components to excessive forces.

The tool of the invention is designed for removing a collar from a shaft portion of a lock bolt fastener or the like. In its basic form, the tool comprises a body having a forward end portion that defines a cradle, a slider slidably mounted in the body, and a lever pivotably attached to the body. The cradle has an opening extending vertically therethrough. This opening is dimensioned to surroundingly receive the collar. The slider has two vertically and rearwardly extending cutting edges separated by a slot extending vertically through the slider. The slot is dimensioned to closely receive the shaft portion of the fastener. The lever is positioned to engage the slider to thrust the slider horizontally forward, when the cradle has been positioned around the collar, to urge the cutting edges against the collar.

The slider preferably has a spreading surface extending laterally outwardly and rearwardly from each cutting edge to guide movement of cut portion of the collar away from the shaft portion of the fastener. Another preferred feature of the tool is a cradle that has a pair of rounded protrusions extending into a forward portion of the opening through the cradle. The protrusions are positioned to align the shaft portion of the fastener with the slot in the slider. The protrusions are dimensioned to provide space around the collar in the cradle opening for cut portions of the collar to move away from the shaft portion. The preferred embodiment of the tool of the invention has both of these features of slider spreading surfaces and protrusions formed by the cradle. The two features function cooperatively to neatly cut and peel the collar away from the shaft portion.

The engagement of the slider by the lever may be accomplished in various ways. Preferably, the lever has an inner end portion that is pivotably attached to the body and that has an actuating cam surface formed thereon. The cam surface is positioned to engage the slider and slide the slider forward when the lever is pivoted. This arrangement has the advantages of relative structural simplicity and ease and reliability of operation. The retracting of the slider is preferably also accomplished by operation of the lever. A retracting cam surface may be formed on the inner end of the lever and positioned to engage the slider to slide it rearward when the lever is pivoted.

In the preferred embodiment of the tool, the inner end of the lever has both an actuating cam surface and a retracting cam surface, and a hook is formed on the slider with opposite surfaces that are engaged by these cam surfaces. This arrangement helps maximize the simplicity of the structure of the tool and the ease, reliability, and effectiveness of its operation. In addition, the dual cam surface and hook arrangement facilitates the provision of another preferred feature of the invention, a slider that is separable from the body to permit repair and replacement of the slider. The separability of the slider allows quick and easy replacement of the slider when it requires sharpening or other maintenance or repair or when different slider dimensions are required to adjust the tool to different size fasteners and collars. The separability also helps to reduce the overall cost of repair operations by permitting a single body and lever to be used with a number of different sliders to remove a number of different collar sizes.

A preferred way of accomplishing the removability and replaceability of the slider is to introduce the slider into the body through a rear opening of a cavity defined by the body. In tools of the invention which have this feature and also have a handle toward which the lever is pivotable to thrust the slider forward, the body preferably has a rear portion that is vertically offset from the rear opening of the cavity and extends rearwardly to form the handle. The slider preferably has a plurality of keys projecting therefrom that are slidably receivable into keyways formed by the body and opening onto the cavity, to guide movement of the slider in the cavity. The keys and keyways provide a relatively simple means of centering the slider in the cavity and ensuring smooth sliding movement thereof. The keying arrangement is also highly compatible with the feature of a cavity with a rear opening.

In the operation of the tool of the invention, a portion of the collar may remain in the slot in the slider when the slider is retracted. Therefore, the tool preferably has a means for automatically pushing debris out of the slot when the slider moves rearwardly. This may be easily accomplished by a cleaning pin carried by the body and positioned to push the debris out of the slot.

The collar illustrated in the drawings of this application has a flange which abuts the inner surface of the inner structure joined by the lock bolt. In order to maximize the leverage that can be obtained by the use of the tool of the invention, and thereby maximize the tools effectiveness in cutting the collar, it is desirable for the bottom horizontal surface of the tool to abut such inner surface of the structure. A recess may be formed on the bottom surface of the tool body to receive the flange portion of the collar and thereby permit a firm abutting engagement between the bottom of the tool body and the inner surface of the structure.

The above-discussed and other advantages and features will become apparent from the detailed description of the best mode for carrying out the invention that follows.

BRIEF DESCRIPTION OF THE DRAWINGS

In the drawings, like element designations refer to like parts throughout, and.

BEST MODE FOR CARRYING OUT THE INVENTION

Figure 1:
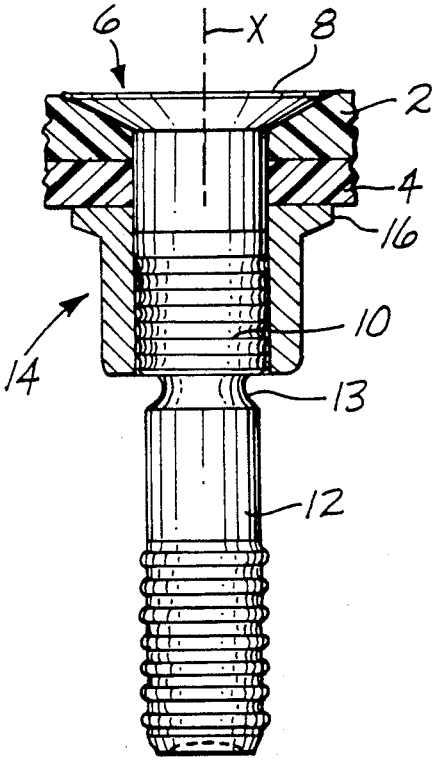
Fig. 1 PRIOR ART
FIG. 1 is a sectional view, with parts shown in elevation, showing an early stage of the installation of a lock bolt fastener.
Figure 2:
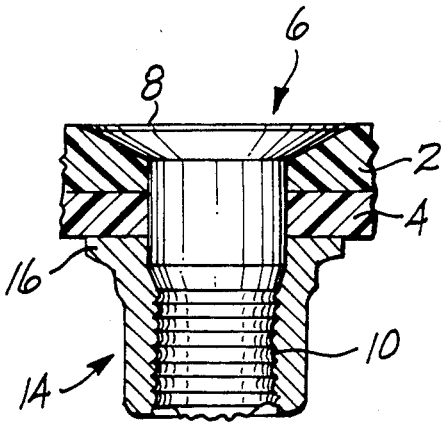
Fig. 2 PRIOR ART
FIG. 2 is like FIG. 1 except that it shows the completed installation.
Figure 3:
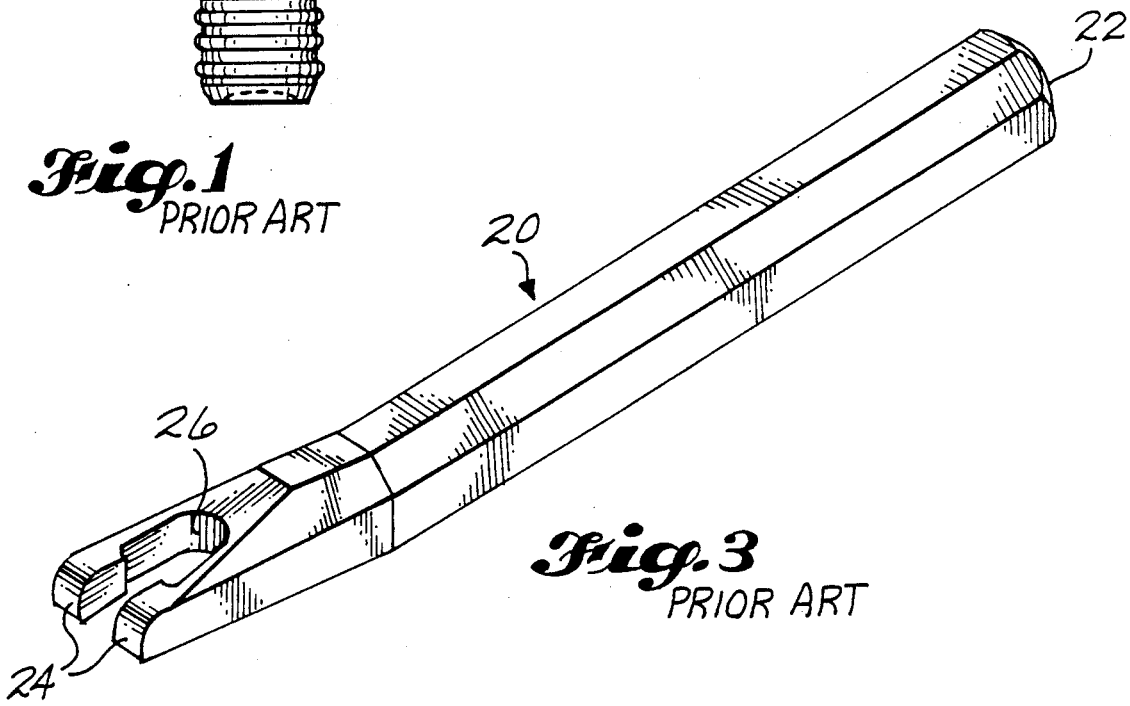
Fig. 3 PRIOR ART
FIG. 3 is a pictorial view of a prior art collar removing tool.
Figure 4:
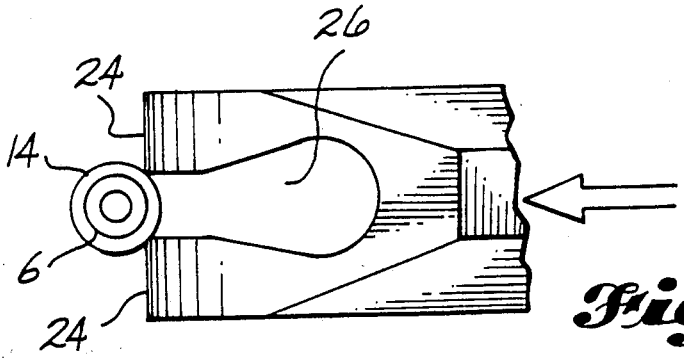
Fig. 4 PRIOR ART
FIG. 4 is a plan view of the front end portion of the tool shown in FIG. 3 illustrating the tool engaging a lock bolt collar.
Figure 5:
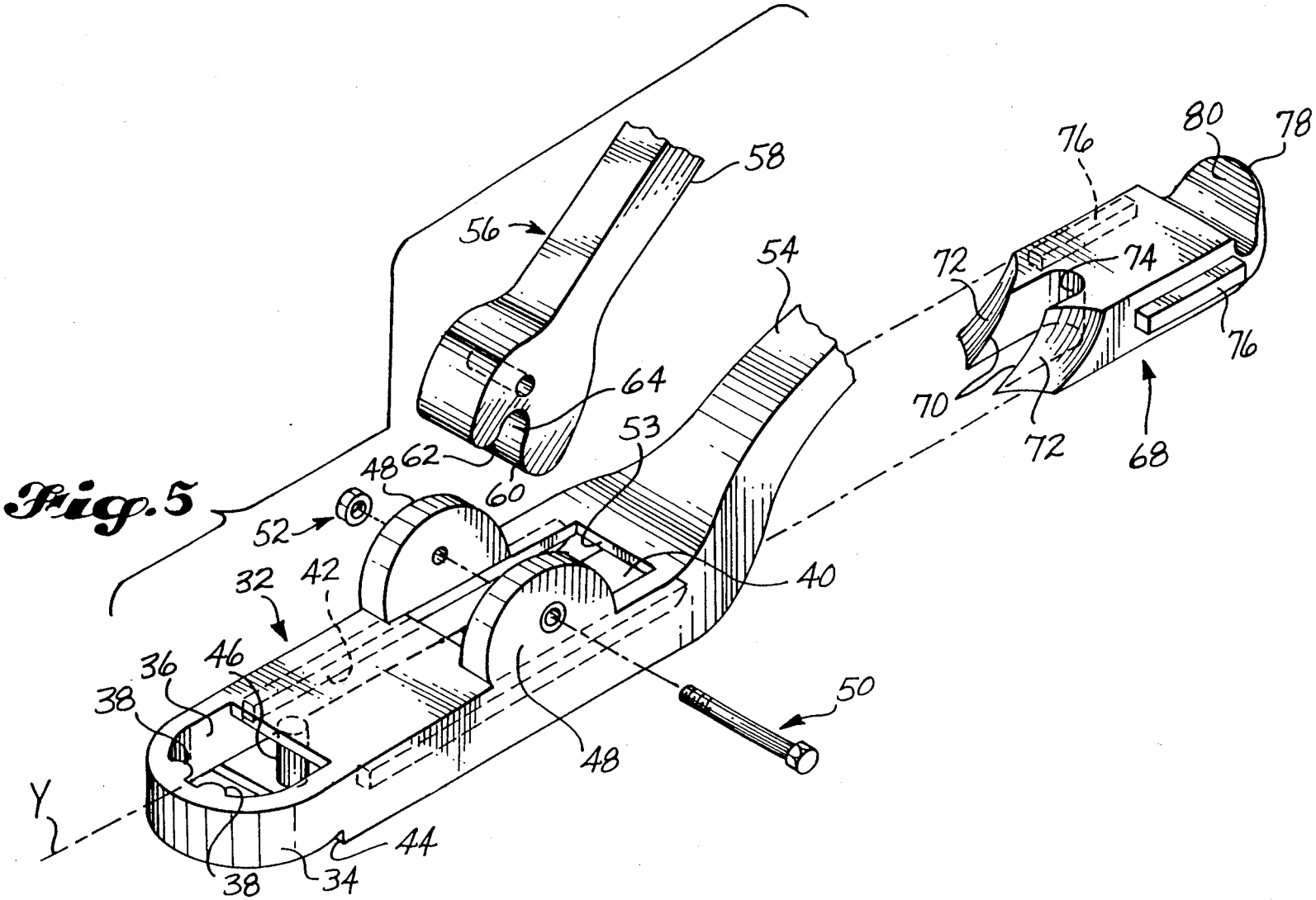
FIG. 5 is an exploded pictorial view of the preferred embodiment of the invention, with rear portions cut away.

FIGS. 5–13 show a tool 30 that is constructed according to the invention and that also constitutes the best mode for carrying out the invention currently known to the applicants. FIGS. 1 and 2 illustrate a type of lock bolt fastener 6 and collar 14. It is anticipated that the tool of the invention will be used primarily in connection with fastening arrangements of the type shown in FIGS. 1 and 2. However, it is of course to be understood that the tool of the invention can also be used to advantage in connection with other types of fastening arrangements in which a collar securing the arrangement cannot be removed without cutting or otherwise destroying the collar.

Referring to FIGS. 5–13, the tool 30 comprises three major elements, a body 32, a slider 68, and a lever 56. The forward end portion of the body 32 forms a cradle 34. The rear end portion of the body 32 forms a handle 54. The cradle 34 has an opening 36 extending vertically therethrough. The opening 36 is bounded by the substantially semicircular vertical wall of the cradle 34 and, at the rear of the opening 36, by the top and bottom walls of the body 32. Two rounded protrusions 38 extend rearwardly into the opening 36 from a forward portion of the cradle wall. These protrusions 38 are arranged symmetrically relative to the longitudinal axis Y of the body 32 (FIGS. 5 and 9) with one protrusion 38 on each side of the axis Y.

The body 32 of the tool 30 defines a cavity 40. The cavity 40 extends longitudinally through the body 32, communicates at its forward end with the vertical opening 36, and opens onto the rear end of the body 32. The handle 54 is vertically offset from the rear opening of the cavity 40 and extends rearwardly therefrom. The top wall of the body 32 has an opening 53 extending therethrough to accommodate the lever 56, as described further below. A keyway 42 is formed on the inner surface of each opposite sidewall of the body 32 and opens onto the cavity 40 and the rear end of the body 32. Each keyway 42 terminates at its front end slightly rearward of the opening 36.

The slider 68 is received into the cavity 40 in the body 32. The slider has two keys 76 projecting outwardly from its opposite side surfaces. These keys 76 are shaped and positioned to be received into the keyways 42 when the slider is in the cavity 40 to guide smooth sliding movement of the slider 68. The rear end of the slider 68 forms a rounded hook 78 having opposite cam surfaces 80, 82 which are engaged by the lever 56 to move the slider 68 forward and rearward in the cavity 40.

The front end of the slider 68 has a slot 74 extending vertically therethrough. The slot 74 extends rearwardly into the slider 68 and, in the assembled tool 30, is aligned with the longitudinal axis Y of the body 32. The forward edges of the slider 68 bordering the slot 74 form opposite cutting edges 70. These edges 70 extend vertically upwardly and rearwardly from the bottom surface of the slider 68 to its top surface. The edges 70 curve as they extend upwardly and rearwardly. A spreading surface 72 is formed on the front end of the slider 68 laterally outwardly of each cutting edge 70. The upper and lower forward edges of the surface 72 curve rearwardly as they extend laterally outwardly. The overall configuration of the cutting edges 70 and spreading surfaces 72 resembles a cleft snowplow.

Figure 6:
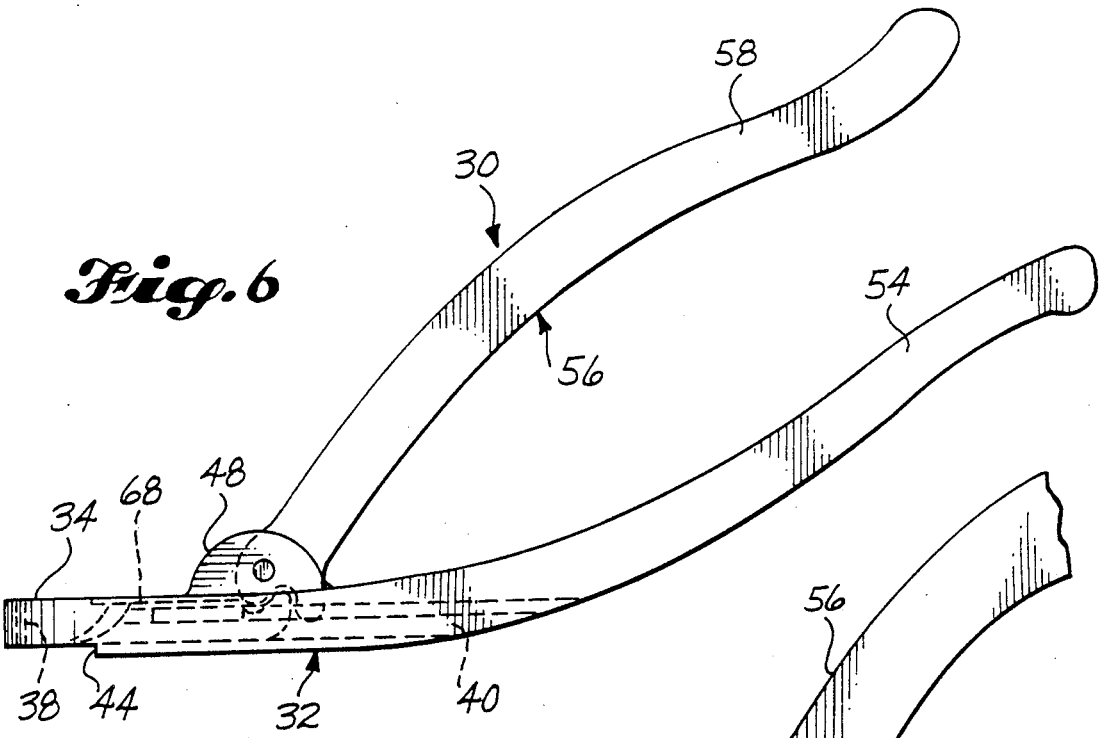
FIG. 6 is an elevational view of the tool shown in FIG. 5 in an assembled condition.

The lever 56 has a forward end which is pivotably attached to the body 32 to move the slider 68 forwardly and rearwardly in the cavity 40. The opposite rear end 58 of the lever 56 forms a handle. As can be seen in FIG. 6, the body and lever handles 54, 58 resemble the handles of a pair of pliers. The lever handle 58 may be squeezed toward the body handle 54 by an operator grasping the two handles 54, 58 with one hand. This one-handed operability of the tool 30 facilitates its use in restricted access areas.

The forward end of the lever 56 is attached to two mounting lugs 48 secured to or integrally formed with the body 32 and extending upwardly from its top surface. The lever 56 is attached by means of a bearing pin screw 50 and a nut 52. The lugs 48 extend rearwardly along the top surface of the body 32 on either side of the opening 53. This arrangement permits the actuating portions 60, 62 of the lever 56 to extend downwardly through the opening 53 into the cavity 40 to engage the hook 78 of the slider 68. A notch 64 extends rearwardly into and laterally through the forward end of the lever 56. The notch 64 separates two rounded fingers at the forward end of the lever 56 whose outer surfaces form cam surfaces 60, 62. In the assembled tool, the hook 78 is received into the notch 64. The lever cam surface 60 engages a cam surface 82 formed by the rear surface of the hook 78, and the lever cam surface 62 engages a forward cam surface 80 formed by the hook 78 (as shown in FIGS. 7 and 8).

Figure 9:
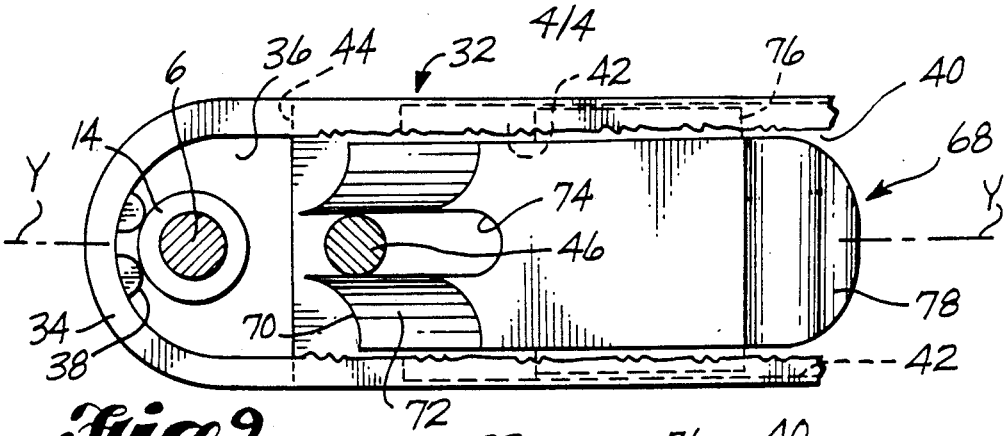
FIG. 9 is a plan view of the tool shown in FIGS. 5–8 positioned to surround a collar installed on a lock bolt, with top and rear portions cut away and parts shown in section.
Figure 10:
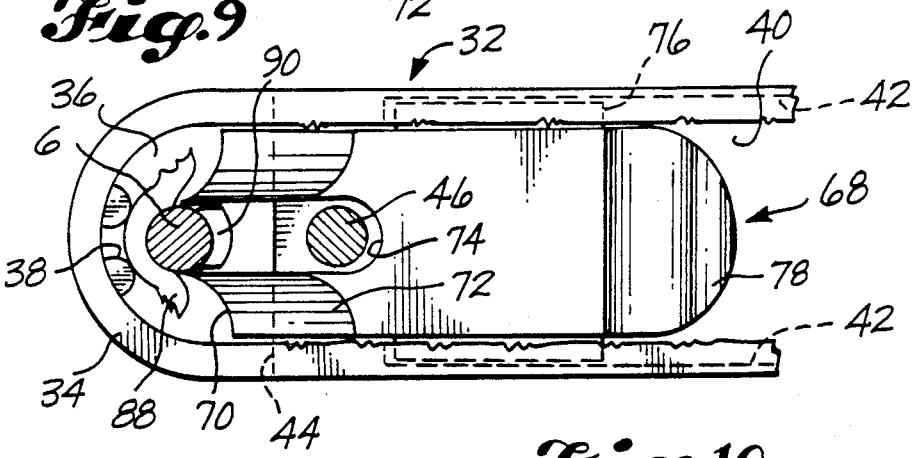
FIG. 10 is like FIG. 9 except that it shows the tool near the end of the collar removing procedure.
Figure 11:
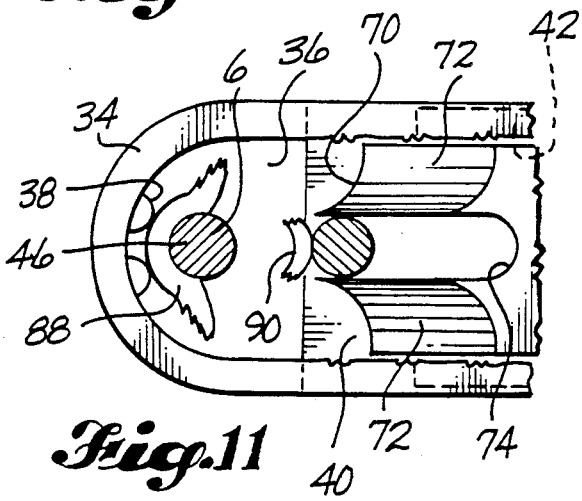
FIG. 11 is like FIGS. 9 and 10 except that it shows the slider retracting after cutting the collar.
Figure 13:
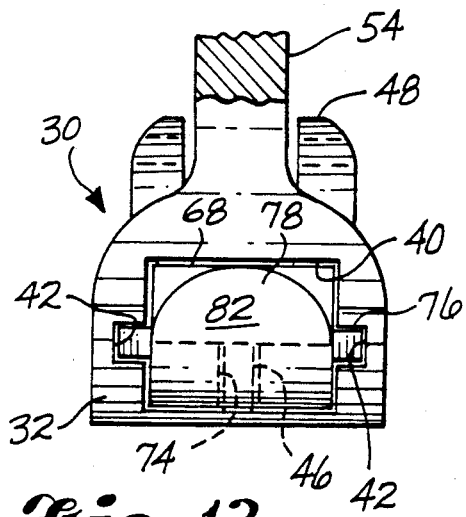
FIG. 13 is a rear end view of the tool shown in FIGS. 5–10 12, with foreground portions cut away.
Figure 12:
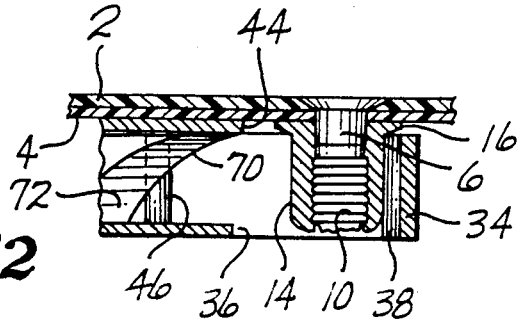
FIG. 12 is a sectional view, with parts shown in elevation, of the front end portion of tool shown in FIGS. 5–11 positioned around a collar.
Figure 9:
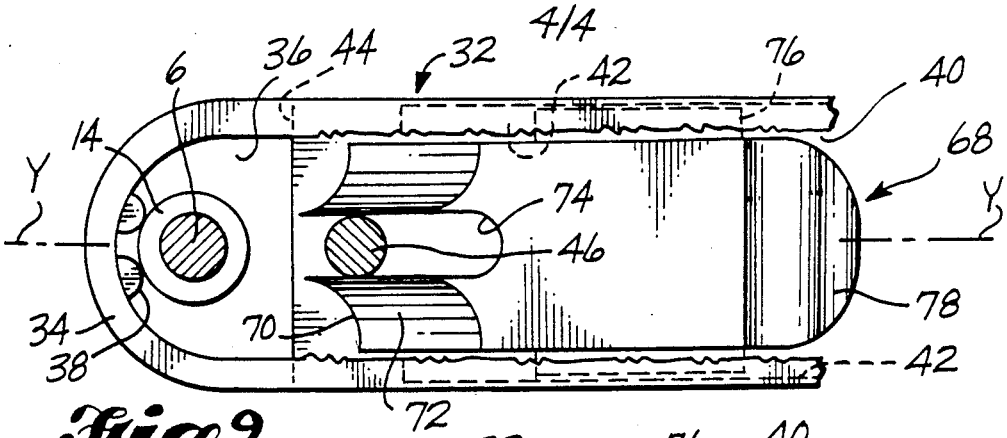
Figure 10:
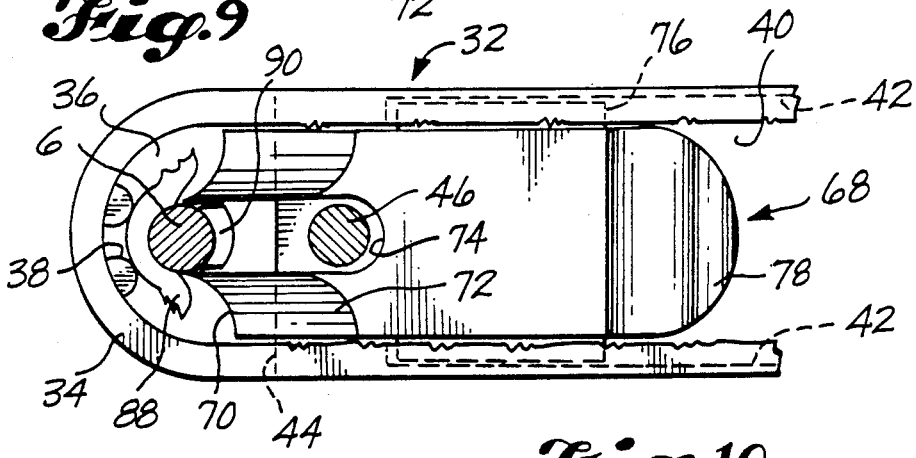
Figure 13:
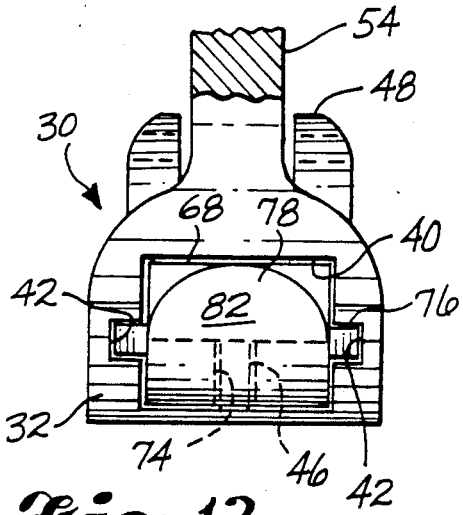
Figure 11:
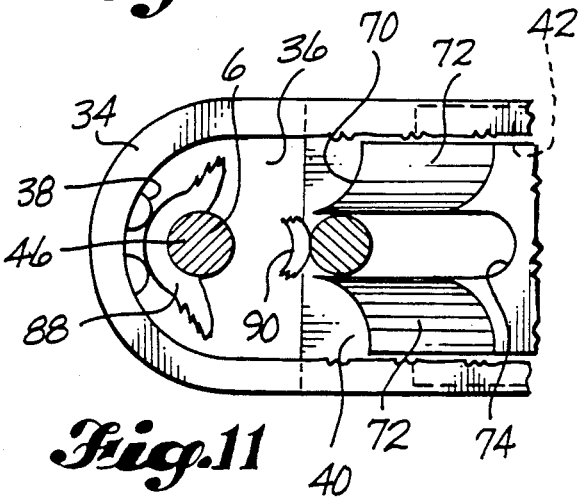
Figure 12:
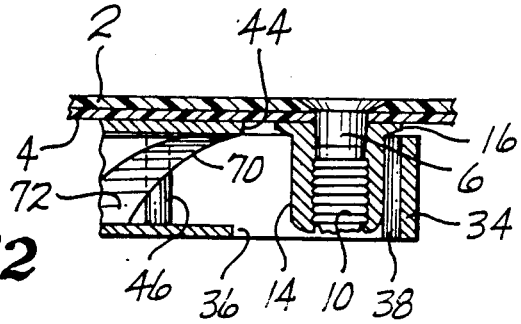

In operation, the tool 30 is positioned with the cradle 34 surrounding a collar 14 which is to be removed, as shown in FIGS. 9–12. The collar 14 extends vertically into the cradle opening 36. The collar 14 is centered laterally in the opening 36 and aligned with the longitudinal axis Y and the slot 74 by engagement with the rounded protrusions 38. As can be seen in FIG. 10, the slot 74 is dimensioned to closely receive the shaft of the fastener 6. Referring to FIG. 12, the tool 30 is positioned so that its bottom surface abuts the inner surface of the structure 2, 4 through which the fastener 6 extends. Since the flange 16 of the collar 14 is adjacent to this inner surface, the body 32 has a recess 44 formed on its bottom surface to clear the flange 16 and allow the body to abut the structure 2, 4. This arrangement helps to stabilize the tool 30 and to maximize the amount of leverage achieved in the cuttinq operation.

Figure 7:
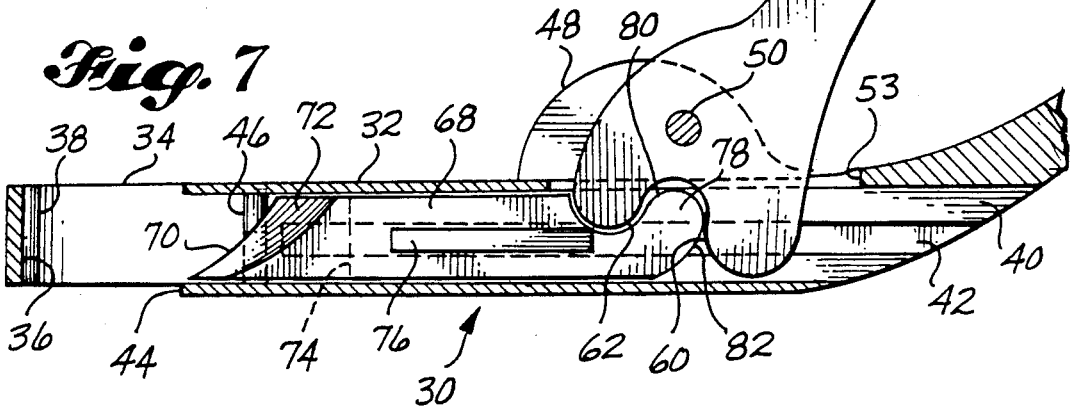
FIG. 7 is an enlarged elevational view, with parts shown in section, of the forward portion of the tool shown in FIG. 6.

When the tool 30 is being positioned around the collar 14, the lever 56 and slider 68 are in the positions shown in FIGS. 7 and 9. Once the tool 30 has been positioned, the lever handle 58 is simply squeezed toward the body handle 54 to actuate the tool 30. As the lever handle 58 is squeezed, the lever surface 60 engages the hook surface 82 to push the slider 68 in a forward horizontal direction toward the collar 14. As the slider 68 moves forwardly, the cutting edges 70 cut into the collar 14 and the spreading surfaces 72 spread the cut collar material 88 laterally (radially) outwardly away from the shaft of the fastener 6, as shown in FIG. 10. The gradual engagement of the edges 70 with the collar 14 provides a steady substantially nonjarring cutting force and helps reduce the magnitude of force required. The sloping and curving edges 70 and surfaces 72 push the spreading collar material 88 upwardly (toward the top of the tool body 32) away from the fastener shaft. The spacing of the collar 14 away from the cradle sidewalls by the protrusions 38 ensures that there is sufficient room to accommodate the cut spreading portions 88 of the collar 14. The engagement of the collar 14 in the cradle 34 stabilizes the tool 30 and helps maximize the effective cutting force.

Figure 8:
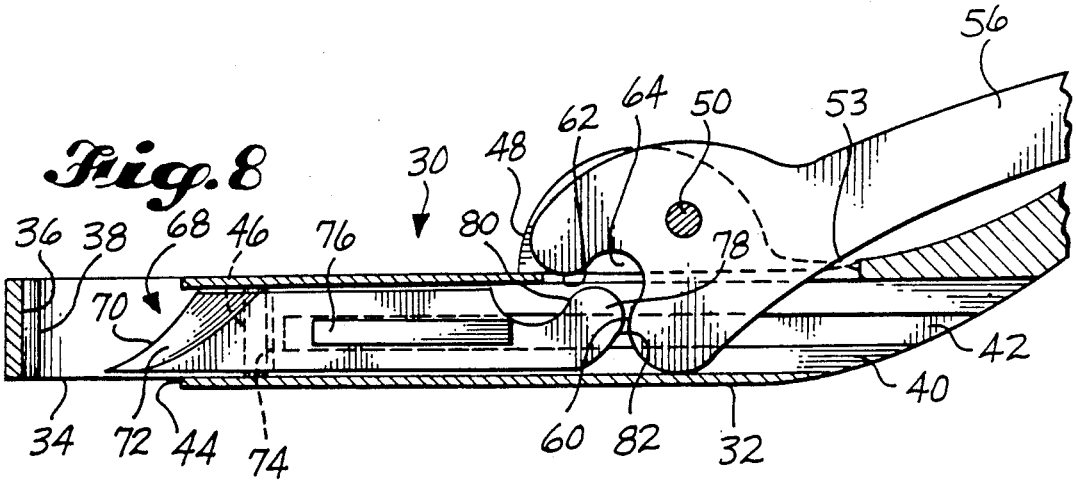
FIG. 8 is like FIG. 7 except that it shows the slider in a forward position.

The position of the slider 68 at the end of the cutting operation is shown in FIGS. 8 and 10, and the position of the lever 56 is shown in FIG. 8. After the collar 14 has been cut, the lever handle 58 is moved back away from the body handle 54. This causes the lever cam surface 62 to engage the slider cam surface 80 to retract the slider 68 rearwardly. As the slider 68 retracts, a piece 90 of the collar 14 separated from the portion 88 that has been spread away from the fastener 6 by the spreading surfaces 72 has a tendency to remain in the slider slot 74. In order to automatically clean this collar piece 90 out of the slot 74, the tool body 32 is provided with a cleaning pin 46 which is secured to and extends vertically between the top and bottom walls of the body 32. The pin 46 is aligned with the slot 74 as shown in FIGS. 9–11. FIG. 11 illustrates the pin 46 pushing the collar fragment 90 out of the slot 74 as the slider 68 is retracted. When the tool 30 is removed from the cut collar, the main spread portion 88 of the collar may be easily pulled away from the fastener 6.

A feature of the invention is the easy removability and replaceability of the slider 68. To accomplish removal of the slider 68 from the body 32, all that is required is the unscrewing of the nut 52, the removal of the bearing pin screw 50 and lever 56, and the sliding of the slider 68 out through the rear opening in the body 32 formed by the rear end of the cavity 40. (See FIG. 13.) Then the slider 68 may be replaced another slider of the same or a different size. Replacement of a slider of the same size may be desired, for example, when the cutting edges 70 are dull or the slider has become damaged in some way. The cutting edges 70 need not be razor sharp, but are required to be somewhat sharp in order to cut a collar to accomplish its removal. The slider 68 may be replaced with a different slider having a slot 74 dimensioned to closely receive the shaft of a different size fastener 6. In this manner, the same tool body 32 and lever 56 may be used to remove a variety of sizes of collars.

Although the preferred embodiment of the invention has been illustrated and described herein, it is intended to be understood by those skilled in the art that various modifications and omissions in form and detail may be made without departing from the spirit and scope of the invention as defined by the following claims.

What is claimed is:

1. A tool for removing a collar from a shaft portion of a lock bolt type fastener, said tool comprising:

a body having a forward end portion that defines a cradle; said cradle having an opening extending vertically therethrough, said opening being dimensioned to surroundingly receive the collar;

a slider slidably mounted in said body and having two vertically and rearwardly extending cutting edges separated by a slot extending vertically through said slider, said slot being dimensioned to closely receive said shaft portion; and a lever pivotally attached to said body and positioned to engage said slider to thrust said slider horizontally forward, when said cradle has been positioned around said collar, to urge said cutting edge gradually into cutting engagement with said collar.

2. The tool of claim 1, in which said slider has a spreading surface extending laterally outwardly and rearwardly from each said cutting edge to guide movement of cut portions of said collar away from said shaft portion and peel said cut portions away from said shaft portion.

3. The tool of claim 2, in which said cradle has a pair of rounded protrusions extending into a forward portion of said opening; said protrusions being positioned to align said shaft portion with said slot, and dimensioned to provide space around said collar in said opening for cut portions of said collar to move away from said shaft portion.

4. The tool of claim 3, further comprising a cleaning pin carried by said body and positioned to push debris out of said slot when said slider moves rearwardly.

5. The tool of claim 3, in which said body has a bottom horizontal surface positioned to abut a surface of a workpiece through which said fastener extends, and said bottom surface has a recess formed thereon to receive a flange portion of said collar adjacent to said surface of said workpiece.

6. The tool of claim 2, further comprising a cleaning pin carried by said body and positioned to push debris out of said slot when said slider moves rearwardly.

7. The tool of claim 2, in which said body has a bottom horizontal surface positioned to abut a surface of a workpiece through which said fastener extends, and said bottom surface has a recess formed thereon to receive a flange portion of said collar adjacent to said surface of said workpiece.

8. The tool of claim 1, in which said cradle has a pair of rounded protrusions extending into a forward portion of said opening; said protrusions being positioned to align said shaft portion with said slot, and dimensioned to provide space around said collar in said opening for cut portions of said collar to move away from said shaft portion.

9. The tool of claim 8, further comprisinq a cleaning pin carried by said body and positioned to push debris out of said slot when said slider moves rearwardly.

10. The tool of claim 8, in which said body has a bottom horizontal surface positioned to abut a surface of a workpiece through which said fastener extends, and said bottom surface has a recess formed thereon to receive a flange portion of said collar adjacent to said surface of said workpiece.

11. The tool of claim in which said slider is separable from said body to permit repair and replacement of said slider.

12. The tool of claim 11, in which said body defines a cavity into which said slider is slidably received, said cavity having a rear opening to permit removal of said slider from said cavity; and said body has a rear portion that is vertically offset from said rear opening and forms a handle toward which said lever is pivotable to thrust said slider forward.

13. The tool of claim 12, in Which said body defines a plurality of keyways opening onto said cavity, and said slider has a plurality of keys projecting therefrom slidably receivable into said keyways to guide movement of said slider in said cavity.

14. The tool of claim 11, in which said body defines a cavity into which said slider is slidably received, said cavity having a rear opening to permit removal of said slider from said cavity; and said body further defines a plurality of keyways opening onto said cavity, and said slider has a plurality of keys projecting therefrom slidably receivable into said keyways to guide movement of said slider in said cavity.

15. The tool of claim 1, in which said lever has an inner end portion that is pivotably attached to said body and that has an actuating cam surface formed thereon positioned to engage said slider and slide said slider forward when said lever is pivoted.

16. The tool of claim 15, in which said inner end portion has a retracting cam surface formed thereon positioned to engage said slider and slide said slider rearward when said lever is pivoted.

17. The tool of claim 16, in which said slider has a hook formed thereon with opposite surfaces that are engaged by said actuating cam surface and said retracting cam surface, respectively.

18. The tool of claim 1, in which said lever has an inner end portion that is pivotably attached to said body and that has a retracting cam surface formed thereon positioned to engage said slider and slide said slider rearward when said lever is pivoted.

19. The tool of claim 1, further comprising a cleaning pin carried by said body and positioned to push debris out of said slot when said slider moves rearwardly.

20. The tool of claim 1, in which said body defines a cavity into which said slider is slidably received, and a plurality of keyways opening onto said cavity; and said slider has a plurality of keys projecting therefrom slidably receivable into said keyways to guide movement of said slider in said cavity.

21. The tool of claim 1, in which said body has a bottom horizontal surface positioned to abut a surface of a workpiece through which said fastener extends, and said bottom surface has a recess formed thereon to receive a flange portion of said collar adjacent to said surface of said workpiece.

* * * * *

UNITED STATES PATENT AND TRADEMARK OFFICE

CERTIFICATE OF CORRECTION

PATENT NO. : 4,989,325

DATED : February 5, 1991

INVENTOR(S) : John E. Durkin, K. Peter Kenney, and Dean F. Hobart

It is certified that error appears in the above-identified patent and that said Letters Patent is hereby corrected as shown below:

Sheet 5 of the drawings, delete the entire sheet (duplicate of sheet 4).

Col. 3, line 38, "portion" should be -- portions --.

Co' 4, line 45, "tools" should be -- tool's --.

Col. 5, lines 25 and 26, "Figs. 5-10 12," should be -- Figs. 5-12, --.

Claim 11, col. 9, line 3, after "claim", insert -- 1, --.

Claim 13, col. 9, first line of claim, "Which" should be -- which --.

Signed and Sealed this

Eighteenth Day of August, 1992

*Attest:*

DOUGLAS B. COMER

*Attesting Officer*

*Acting Commissioner of Patents and Trademarks*